US006175827B1

(12) United States Patent
Cordery et al.

(10) Patent No.: US 6,175,827 B1
(45) Date of Patent: Jan. 16, 2001

(54) ROBUS DIGITAL TOKEN GENERATION AND VERIFICATION SYSTEM ACCOMMODATING TOKEN VERIFICATION WHERE ADDRESSEE INFORMATION CANNOT BE RECREATED AUTOMATED MAIL PROCESSING

(75) Inventors: Robert A. Cordery, Danbury; Leon A. Pintsov, West Hartford, both of CT (US)

(73) Assignee: Pitney Bowes Inc., Shelton, CT (US)

( * ) Notice: Under 35 U.S.C. 154(b), the term of this patent shall be extended for 0 days.

(21) Appl. No.: 09/052,419

(22) Filed: Mar. 31, 1998

(51) Int. Cl.[7] ..... G07B 17/00
(52) U.S. Cl. ..... 705/410; 705/60; 705/401; 705/408
(58) Field of Search ..... 380/55; 705/401, 705/405, 408, 410, 60, 62

(56) References Cited

U.S. PATENT DOCUMENTS

| | | | |
|---|---|---|---|
| 3,978,457 | 8/1976 | Check et al. | 340/172.5 |
| 4,168,533 | 9/1979 | Schwartz | 364/900 |

(List continued on next page.)

FOREIGN PATENT DOCUMENTS

| | | | |
|---|---|---|---|
| 782108 | * | 7/1997 | (EP) . |
| 0 782 108 A2 | | 7/1997 | (EP) . |
| 952558 | * | 10/1999 | (EP) . |
| 11-345353 | * | 12/1999 | (JP) . |

OTHER PUBLICATIONS

"Interact Commerce and Stamps.com Partner to Provide SOHOs a One–Step Contact Management and Mailing Solution"; Business Wire, Jul. 11, 2000, p. 2295.*

The Reed–Solomon Code (R. Blat, *Theory and Practice of Error Control Codes*, Addison Wesley Publication Co., 1984, pp. 174 and 175.

Information Based Indicia Program (IBIP) Open System Postal Security Device (PSD) Specification, Jul. 23, 1997.

Information Based Indicia Program (IBIP) Open System Indicium Specification, Jul. 23, 1997.

Information Based Indicia Program Host System Specification, issued Oct. 9, 1996.

Information Based Indicia Program Key Management Plan, Apr. 25, 1997.

*Primary Examiner*—Edward R. Cosimano
(74) *Attorney, Agent, or Firm*—Kimberly S. Chotkowski; Michael E. Melton

(57) ABSTRACT

A method for generating evidencing information for a document includes generating an error correction code and generating a digital token employing the error correction code. A method for verifying authentication and integrity information printed on a mail piece includes obtaining an error correction code printed on the document and employing the obtained error correction code to verify the validity of the evidencing information. A method for verifying the evidencing information printed on a mail piece includes obtaining an error correction code printed on a mail piece and determining that the obtained error correction code is inaccurate. The information employed to generate the inaccurate error correction code is obtained and an error correction code is generated from the obtained information. The generated error correction code is employed to verify the validity of the evidencing information. The document may be a mail piece and the evidencing information postage evidencing information with the error correction code being for at least a portion of destination address information.

19 Claims, 7 Drawing Sheets

U.S. PATENT DOCUMENTS

| | | | |
|---|---|---|---|
| 4,222,518 | 9/1980 | Simjian et al. | 335/375 |
| 4,226,360 | 10/1980 | Simjian | 235/375 |
| 4,301,507 | 11/1981 | Soderberg et al. | 364/464 |
| 4,349,741 | 9/1982 | Bobart et al. | 250/568 |
| 4,493,252 | 1/1985 | Clark | 101/71 |
| 4,579,054 | 4/1986 | Buan et al. | 101/91 |
| 4,587,411 | 5/1986 | Obstfelder et al. | 235/437 |
| 4,629,871 | 12/1986 | Scribner et al. | 325/375 |
| 4,649,266 | 3/1987 | Eckart | 235/432 |
| 4,725,718 | 2/1988 | Sansone et al. | 235/495 |
| 4,757,532 | 7/1988 | Gilham | 380/23 |
| 4,757,537 | 7/1988 | Edelmann | 380/51 |
| 4,775,246 | 10/1988 | Edelmann et al. | 380/23 |
| 4,800,505 | 1/1989 | Axelrod et al. | 364/48 |
| 4,831,555 | 5/1989 | Sansone et al. | 364/519 |
| 4,853,961 | 8/1989 | Pastor | 380/21 |
| 4,873,645 | 10/1989 | Hunter et al. | 364/479 |
| 4,900,903 | 2/1990 | Wright et al. | 235/380 |
| 4,907,271 | 3/1990 | Gilham | 380/25 |
| 4,934,846 * | 6/1990 | Gilham | 400/104 |
| 5,073,954 | 12/1991 | Van Tyne et al. | 382/18 |
| 5,189,700 | 2/1993 | Blandford | 380/23 |
| 5,390,251 | 2/1995 | Pastor et al. | 380/21 |
| 5,422,821 | 6/1995 | Allen et al. | 364/478 |
| 5,448,641 | 9/1995 | Pintsov et al. | 380/51 |
| 5,454,038 | 9/1995 | Cordery et al. | 380/23 |
| 5,586,036 * | 12/1996 | Pintsov | 705/408 |
| 5,612,889 * | 3/1997 | Pintsov et al. | 700/226 |
| 5,625,694 | 4/1997 | Lee et al. | 380/23 |
| 5,675,650 * | 10/1997 | Cordery et al. | 380/23 |
| 5,768,132 * | 6/1998 | Cordery et al. | 705/410 |
| 5,936,865 * | 8/1999 | Pintsov et al. | 700/107 |
| 6,058,190 * | 5/2000 | Cordery et al. | 380/51 |

* cited by examiner

ROBUS DIGITAL TOKEN GENERATION AND VERIFICATION SYSTEM ACCOMMODATING TOKEN VERIFICATION WHERE ADDRESSEE INFORMATION CANNOT BE RECREATED AUTOMATED MAIL PROCESSING

FIELD OF THE INVENTION

The present invention relates to providing a more efficient processing system with enhanced security by enabling verification of digital tokens where necessary information may not be readable, even when the reading is assisted with the use of conventional error correction codes. More particularly, the present invention relates to robust mail piece digital token verification systems, increasing the percentage of mail pieces where token verification can be achieved, even where full addressee information may not be able to be recreated, and with enhanced ability to automatically read addressee block information by providing on each mail piece information concerning the address block structure.

BACKGROUND OF THE INVENTION

Postage metering systems print and account for postage and other unit value printing such as parcel delivery service charges and tax stamps. These systems have been both electronic and mechanical. Some of the varied types of postage metering systems are shown, for example, in U.S. Pat. No. 3,978,457 for MICROCOMPUTERIZED ELECTRONIC POSTAGE METER SYSTEM, issued Aug. 31, 1976; U.S. Pat. No. 4,301,507 for ELECTRONIC POSTAGE METER HAVING PLURAL COMPUTING SYSTEMS, issued Nov. 17, 1981; and, U.S. Pat. No. 4,579,054 for STAND ALONE ELECTRONIC MAILING MACHINE, issued Apr. 1, 1986. Moreover, other types of metering systems have been developed which involve different printing systems such as those employing thermal printers, ink jet printers, mechanical printers and other types of printing technologies. Examples of these other types of electronic postage meter are described in U.S. Pat. No. 4,168,533 for MICROCOMPUTER MINIATURE POSTAGE METER, issued Sep. 18, 1979; and, U.S. Pat. No. 4,493,252 for POSTAGE PRINTING APPARATUS HAVING A REMOVABLE PRINT HEAD AND A PRINT DRUM, issued Jan. 15, 1985. These printing systems enable the postage meter system to print variable information which may be alphanumeric and graphic type of information.

Card controlled metering systems have also been developed. These systems have employed both magnetic strip type cards and microprocessor based cards. Examples of card controlled metering systems employing magnetic type cards include U.S. Pat. No. 4,222,518 for METERING SYSTEM, issued Sep. 16, 1980; U.S. Pat. No. 4,226,360 for METERING SYSTEM, issued Oct. 7, 1980; and, U.S. Pat. No. 4,629,871 for ELECTRONIC POSTAGE METER SYSTEM SETTABLE BY MEANS OF A REMOTELY GENERATED INPUT DEVICE, issued Dec. 16, 1986. A microprocessor ("smart card") based card metering system providing an automated transaction system employing microprocessor bearing user cards issued to respective users is disclosed in U.S. Pat. No. 4,900,903 for AUTOMATED TRANSACTION SYSTEM WITH INSERTABLE CARDS FOR TRANSFERRING ACCOUNT DATA, issued Feb. 13, 1990. Moreover, systems have also been developed wherein a unit having a non-volatile read/write memory which may consist of a EEPROM is employed. One such system is disclosed in U.S. Pat. No. 4,757,532 for SECURE TRANSPORT OF INFORMATION BETWEEN ELECTRONIC STATIONS, issued Jul. 12, 1988 and U.S. Pat. No. 4,907,271 for SECURE TRANSMISSION OF INFORMATION BETWEEN ELECTRONIC STATIONS, issued Mar. 6, 1990.

Postage metering systems have also been developed which employ encrypted information printed on a mail piece. The postage value for a mail piece may be encrypted together with other data to generate a digital token. A digital token is encrypted information that authenticates and enables verification of the integrity of the information imprinted on a mail piece including postage values. Examples of postage metering systems which generate and employ digital tokens are described in U.S. Pat. No. 4,757,537 for SYSTEM FOR DETECTING UNACCOUNTED FOR PRINTING IN A VALUE PRINTING SYSTEM, issued Jul. 12, 1988; U.S. Pat. No. 4,831,555 for SECURE POSTAGE APPLYING SYSTEM, issued May 16, 1989; U.S. Pat. No. 4,775,246 for SYSTEM FOR DETECTING UNACCOUNTED FOR PRINTING IN A VALUE PRINTING SYSTEM, issued Oct. 4, 1988; U.S. Pat. No. 4,873,645 for SECURE POSTAGE DISPENSING SYSTEM, issued Oct. 10, 1989; and, U.S. Pat. No. 4,725,718 for POSTAGE AND MAILING INFORMATION APPLYING SYSTEM, issued Feb. 16, 1988 and the system disclosed in the various United States Postal Service published specifications such as Information Based Indicium Program Key Management System Plan, dated Apr. 25, 1997; Information Based Indicia Program (IBIP) Open System Indicium Specification, dated Jul. 23, 1997; Information Based Indicia Program Host System Specification dated Oct. 9, 1996, and Information Based Indicia Program (IBIP) Open System Postal Security Device (PSD) Specification dated Jul. 23, 1997.

These systems, which may utilize a device termed a postage evidencing device (PED), employ an encryption algorithm to encrypt selected information to generate the digital token. The encryption of the information provides security to prevent altering of the printed information in a manner such that any change in the values printed in the postal revenue block is detectable by appropriate verification procedures.

Typical information which may be encrypted as part of the input to a digital token includes the value of the imprint, the origination zip code, the recipient addressee information (such as, for example, delivery point destination code), the date and a serial piece count number. These items of information when encrypted with a secret or private key and imprinted on a mail piece provide a very high level of security which enables the detection of any attempted modification of the information in the postal revenue block, where this information may be imprinted both in encrypted and unencrypted form. These digital token systems can be utilized with both a dedicated printer, that is, a printer that is securely coupled to an accounting module such that printing cannot take place without accounting or in systems employing non-dedicated printers and secure accounting system. In this case, such as in personal or (wide area or local area) network computing systems, the non-dedicated printer may print the digital token as well as other information.

Digital tokens need to be computed and printed, for example, in the postal revenue block for each mail piece. The digital token transformation (DTT) computation requires a secret or private key, that has to be protected and may be periodically updated. One of the more difficult problems with encrypted evidence of postage payment is the key management problem. Indeed, the use two digital tokens (postal and vendor) is described in pending U.S. Pat. No. 5,390,251 for MAIL PROCESSING SYSTEM INCLUDING DATA CENTER VERIFICATION FOR MAILPIECES, issued Feb. 14, 1995, the entire disclosure of which is hereby incorporated by reference. In such systems, the digital tokens are usually computed for every mail piece processed. This computation involves taking input data such as serial piece count, date, origination postal code and postage amount and encrypting this data with secret keys shared by the postage evidencing device (PED) and postal or courier service and by the postage evidencing device and device manufacturer or vendor. This sharing requires coordination of key updates, key protection and other measures commonly referred to as a key management system. The computation of digital tokens takes place upon request to generate tokens by a mailer. This computation is performed by the postage evidencing device. Thus, the postage evidencing device needs to have all the information required for computation, and, most significantly encryption keys. Moreover, refilling the postage evidencing device with additional postage funds also requires separate keys and a management process. In these systems, the process of token generation is accomplished with real time token computation and tokens can be computed for any combination of input parameters allowed by the system.

Various enhanced systems have been developed including systems disclosed in U.S. Pat. No. 5,454,038 for ELECTRONIC DATA INTERCHANGE POSTAGE EVIDENCING SYSTEM, issued Sep. 26, 1995; U.S. Pat. No. 5,448,641 for POSTAL RATING SYSTEM WITH VERIFIABLE INTEGRITY, issued Sep. 5, 1995; and, U.S. Patent No. 5,625,694, for METHOD OF INHIBITING TOKEN GENERATION IN AN OPEN METERING SYSTEM, issued Apr. 29, 1997, the entire disclosure of which is hereby incorporated by reference.

As noted above, it has been recognized that addressee information can be incorporated into the digital token. This provides enhanced security. The inclusion of addressee information in the digital token insures that for an individual to perpetrate a copying attack by copying a valid indicia from one mail piece on another mail piece and entering it into the mail stream, the fraudulent mail piece must be addressed to the same addressee as the original valid mail piece. If this has not been done, the fraudulent mail piece would be detectable as having an invalid indicia upon verification at a mail processing facility.

It has also been recognized that a level of enhanced security can be obtained by generating the digital tokens using a subset of addressee information. This concept is disclosed in published European Patent Application Publication No. 0782108 for A METHOD FOR AUTHENTICATING POSTAGE EVIDENCING USING DIGITAL TOKENS GENERATED FROM A SUBSET OF ADDRESSEE INFORMATION, filed Dec. 19, 1996 and published Jul. 2, 1997. The published European application discloses, inter alia, using the hash code of a predetermined appropriate section of each address field as part of the digital token transformation process. It is suggested that the first 15 characters of each line can be selected as such appropriate section of each address field for authentication. An error correction code is generated for the selected address data using, for example, Reed Solomon or BCH algorithms. A secure hash of this section of the address field data is generated, which is sent to a vault (PED) along with the postage required and date data. This information, the section of the address field, is part of a request for a digital token. The vault which may be coupled to a personal computer (PC) generates the digital token using this data. The error correcting code is printed on the mail piece in alpha numeric characters or bar code format. Upon verification, an OCR system reads the delivery address from the mail piece and the data from the indicium. Using an OCR or bar code reader, the error correcting code is also read. An error correcting algorithm is executed using the error correcting code. If errors are not correctable, then the recognition process is notified of a failure. If correctable, the appropriate section of each address field is selected for authentication. A secure hash of the selected data is generated during the verification process. A secure hash and the postal data are then sent to the verifier which then generates digital tokens that are compared to the digital tokens printed on the mail piece to complete the verification process.

SUMMARY OF THE INVENTION

It has been discovered that enhanced security can be provided in various postal systems employing digital tokens as evidence of postage payment by incorporating information into the digital token which is easy to recreate from the face of the mail piece.

It has been further discovered that many mail pieces have addresses that are difficult and sometimes impossible to fully read, such that the digital token imprinted on the mail piece cannot be verified.

It is an object of the present invention to provide a secure postage token generation and verification system which alleviates this difficulty by providing redundant information which can be more easily recreated.

It has been further discovered that the process of addressing, postage evidencing, mail sorting and automated payment verification can be greatly facilitated by computing certain auxiliary information from the destination address data.

It has also been discovered that the objective of linking the indicium with the mail piece can be substantially satisfied, worldwide, for all categories of mail, domestic and international, without employing the United State Postal Service eleven digit destination point delivery code (DPDC) or its equivalents as addressee information incorporated in the digital token. It has also been discovered that the new method does not necessarily require access to the regularly updated address databases and works for all mail items, even undeliverable as addressed, in this case enabling determination of undeliverability.

It is another object of the present invention to provide a practical universal system for linking a mail piece to a digital token.

It has also been discovered that by printing certain information such as the auxilliary information, in an appropriate location, as for example the vicinity of the destination address block or indicium or both, information capture and processing can be enhanced.

It has been additionally discovered that the above information may be printed in any other location on a mail piece such as in a predetermined easy to locate position, e.g. the upper right hand corner of the mail piece. This information can be a landmark indicative of the mail piece address block, by providing coordinates of the address block using an appropriate coordinate system with origin that can be automatically and easily located without errors.

It has also been discovered that using an error correction code of addressee information which is incorporated into the digital token as part of the digital token transformation process, provides enhanced functionality for mail processing and enables automatic verification of a greater percentage of the mail pieces.

It is an object of the present invention to utilize an error correction code as information representing addressee information in a digital token such that the error correction code is redundant with the address information. Accordingly, where the error correction code can be read from the mail piece, the digital token may still be verifiable even if the addressee information is not or is only partially readable, since the error correction code may be able to be recreated from the redundant information in the addressee information itself when readable. A new error correction code may also be generated from the addressee information where the error correction code is not readable and the new error correction code (which should be identical to the originally imprinted error correction code) is utilized to validate the digital token. Thus, this system is such that where the address is mutilated to a point that it is unable to be reconstructed with the error correction code since there are so many errors in the addressee information, nonetheless, the digital token can be verified because of the error correction code. Where the error correction code is unable to be read, the mail piece digital token can still be verified if the error correction code can be recreated from the address information where it is not obliterated or mutilated beyond use to generate an accurate error correction code.

This provides the ability to process larger portions of mail verifying the digital token and thereby detecting practical attempts to defraud the mail processing system as, for example, by intentionally mutilating a portion of the addressee information while leaving sufficient addressee information such that the mail piece is still deliverable. Also, where the error correction code is not readable, the addressee information can be used.

Moreover, it must be recognized that by utilizing the error correction code as input to the digital token, the attempts to thwart the system by obliterating a portion of the addressee information but leaving enough information so that it is deliverable is protected to a greater extent. This is because where full addressee information is used as part of the digital token verification system, the full address must be recognized and used in processing the verification of the digital token. This also inhibits the ability of unscrupulous mailers to more easily make duplicates to attack the mail stream by copying, for example, an eleven digit delivery point destination code as is used in the United States, and having an address which is inconsistent with this delivery point destination code. In such case, the digital token would verify and, through manual processing, the mail piece may still be appropriately delivered.

It has also been discovered that address block structure information may be included, in easily machine readable form, on each mail piece to facilitate and enhance automated reading of the address block for sorting, delivery and/or verification purposes. The address structure information can serve as input to the digital token transformation (DTT) and/or used to facilitate enhance machine reading.

A method for generating postage evidencing information embodying the present invention includes generating an error correction code for information on a document and generating a digital token employing the error correction code. The information may be a portion of the destination address on a mail piece.

In accordance with an aspect of the present invention a method for evidencing information printed on a document includes obtaining an error correction code printed on a document and employing the obtained error correction code to verify the validity of evidencing information. The evidencing information may be postage evidencing information printed on a mail piece.

In accordance with a feature of the present invention, a method for verifying postage evidencing information printed on a mail piece includes obtaining an error correction code printed on a mail piece and determining that the obtained error correction code is inaccurate. The information employed to generate the error correction code is obtained and an error correction code is generated from the obtained information. The generated error correction code is employed to verify the validity of the postage evidencing information.

In accordance with still another aspect of the present invention a method for verifying postage evidencing information printed on a mail piece includes generating an error correction code from at least a portion of addressee information printed on said mail piece and employing the generated error correction code to verify the validity of said postage evidencing information.

In still another further feature of the present invention a method for generating a mail piece includes generating an error correction code for a destination address and generating address structure information for the destination address. The error correction code and address structure information is imprinted on said mail piece.

In yet still another aspect of the present invention a method for generating evidencing information includes generating an error correction code for information and generating structure information for the information. The error correction code and address information is imprinted on a mail piece and a digital token is generated employing the error correction code and/or the structure information. The information may be postage evidencing information and the error correction code and the structure information can be that of at least a portion of mail piece destination information.

BRIEF DESCRIPTION OF THE DRAWINGS

A complete understanding of the present invention may be obtained from the following detailed description of the preferred embodiment thereof, when taken in conjunction with the accompanying drawings, wherein like reference numerals designate similar elements in the various figures, and in which.

DETAILED DESCRIPTION OF THE PREFERRED EMBODIMENT

General Background

Figure 1:
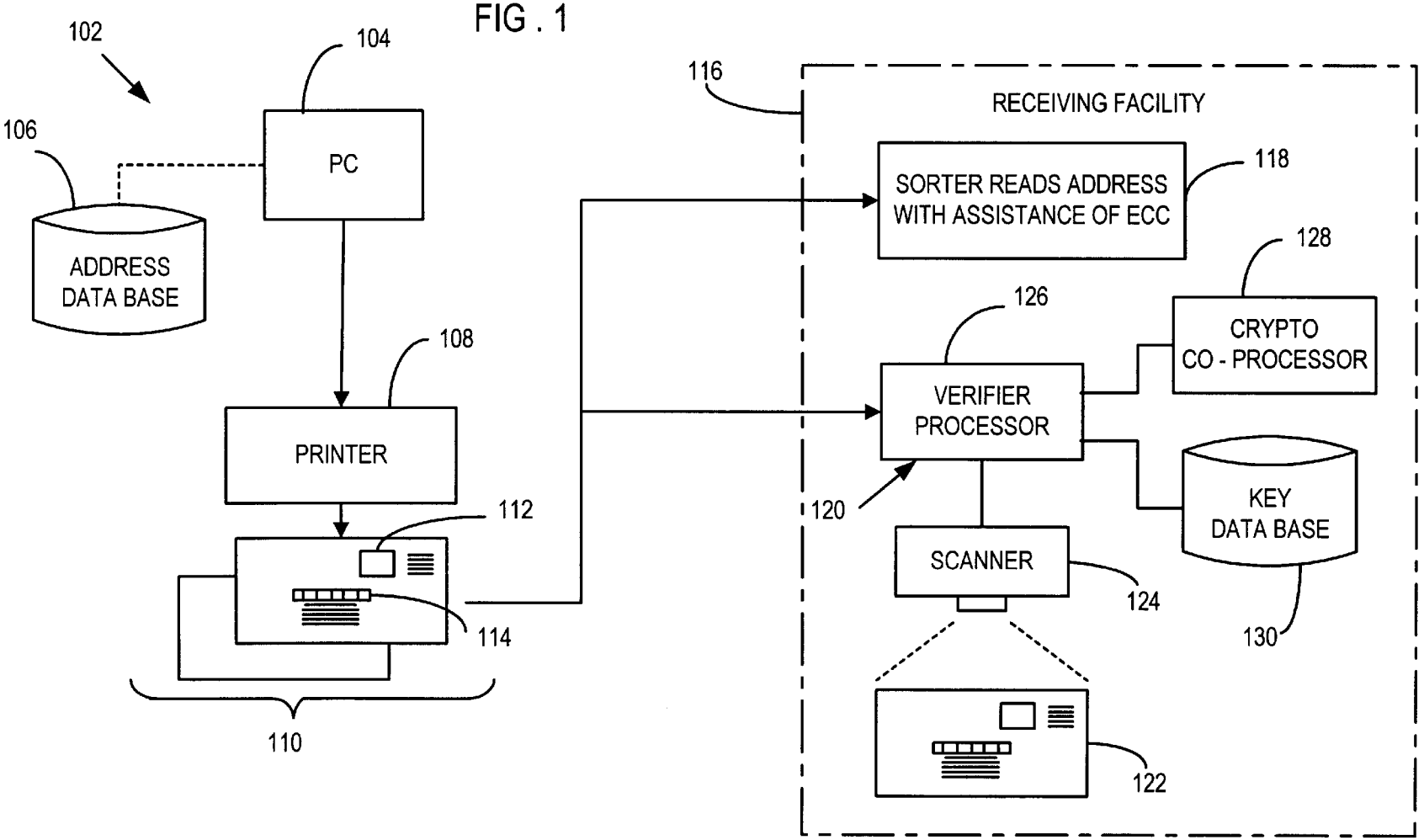
FIG. 1 is a block diagram of a system for printing mail pieces and verifying mail pieces which embodies the present invention.

The main purpose of a digital indicium is to evidence that postage for a given mail item has been paid. Various implementations for digital postal indicia have been proposed. In selecting an implementation, it is desirable that the digital postal indicia satisfy the following set of requirements:

1) Information printed in the indicium shall be linked with payment.

2) Each digital indicium shall be unique.

3) Each digital indicium shall be linked with the mail item for which it provides evidence of payment.

4) Indicium verification process shall be simple and effective, e.g., it should be completely automated except for mail pieces requiring special handling or attention or (if desired) a simple manual process that can be performed by mail carriers who handle mail for delivery.

The first requirement is usually satisfied using cryptographic techniques. In its simplest form the link between the payment and the indicium is achieved by printing encrypted information that authenticates the information imprinted on the mail piece (digital tokens) in the indicium that can be computed only by the device in the possession of secret information (a key). This key serves as an input to an algorithm producing, for example, a message authentication code (MAC) or a digital signature. Each access to the key results in accounting action such as subtraction of the postage from a postage register holding postal money.

The second requirement provides a detection mechanism for unauthorized duplication of indicia. Printing a unique identification on each mail piece satisfies this requirement.

The third requirement is desirable in order to simplify the detection of reused or duplicate indicia. In particular, it is very desirable to achieve the verification of the indicium without access to external sources of information, such as databases of already used and verified indicia. This requirement considerably simplifies means for satisfying the last requirement. Postage meters meet this requirement either by use of unique printers and inks, or by linking information on the mail piece to the indicium.

The system described herein addresses, inter alia, the requirement of the linkage between the mail piece and the indicium. This linkage has been provided by including data, unique to a mail piece, as an input to cryptographic transformation computing the encrypted information (digital tokens). Of the data present on the mail items, there is one primary candidate of such unique data, namely the destination address. By incorporating the destination address into a digital token along with other relevant information e.g. date, postage amount, device identification, the postage evidencing device effectively eliminates possibility of reusing once issued (and paid) indicium information for unpaid mail pieces, with the exception of mail pieces destined to exactly the same address on the same day. This last attack subjects the attacker to high risk (since mail pieces are to the same addressee on the same day), with little economic benefit to the attacker. Thus, it is desirable to include the destination address into digital tokens.

The above approach, however, has to overcome multiple difficulties. Address information and its presentation format must be standardized in such a way that the verification process should be able to produce (based on the address present on the mail piece) the address input data exactly identical to the address input data used during the indicium generation process by the postage evidencing device. This standardization must also accommodate international mail. This means that: a) mail with the destination outside of a given country must be processable as well as domestic mail; and, b) mail within countries which do not use any postal codes or use only relatively short (and therefore not unique to the address) postal codes, that for example easily indicate a post office, must be processable as well. The previous requirements persist even when the address information printed within indicium in a machine-readable format such as two-dimensional bar code.

The root of the problem lies in the fact that a postage evidencing device for many applications computes the indicium information including digital tokens from a computerized file of input data or other computerized input data such as keyboard entry, while a verification process must compute digital tokens from the data scanned (or otherwise obtained, for example, by manual keying) from the mail piece where this data exists in the form of optical images. The process of interpreting optical images in order to obtain a computerized file is notoriously error prone and the probability of error grows fast with the growth of the information content of the optical image. On the other hand cryptographic verification fails, even in the presence of a single error in the interpretation of the optical image. The cryptographic verification process is not error tolerant.

In the United States of America, the United States Postal Service defined an 11 digit destination point delivery code (DPDC) uniquely indicative of the destination address. This code, when present on the mail piece and known to the postage evidence producing device, can serve as the required input to the digital token calculation. However, even in the United States of America this DPDC code is not defined for many addresses. Access to this code requires possession of huge databases that must be distributed to a large number of end users and updated on a frequent basis. This poses a very significant financial burden for mailers and posts. Moreover, a code similar to DPDC does not exists in a vast majority of other countries including major countries of the industrial world, thus reducing utility of the DPDC approach considerably. Additionally, many postal administrations resist introduction of long DPDC viewing them as unnecessary for the main function of the postal service, mainly mail sorting and delivery.

A significant problem also encountered in mail processing is the problem of automatic mail sortation. Solution of this problem usually requires several separate processing steps, namely:

1) Finding the destination address block in the digital image of the face of the envelope.

2) Parsing the address block into lines and words,

3) Segmenting of address words into individual characters,

4) Recognizing individual characters by Optical Character Recognition (OCR) process, 5) Interpreting of address information to execute sorting.

Each of the above-identified processing steps may fail thus frequently introducing irrecoverable errors. Finding the address block, parsing and segmenting may be responsible for up to 60% of failures in processing of machine printed mail, leaving only 40% of errors to the OCR and interpretation. Therefore, it is desirable to assist mail-processing equipment in performing at least the first four processing steps described above.

It is well known, and is being already practiced in several countries, to use address block locators. These address block locators are a specially printed graphic or alphanumeric symbols on the envelope which are relatively easy to locate in the digital image and which are indicative of the location of the destination address in the envelope. In some countries, preprinted vertical lines or special symbols such as asterisks are used. Some other countries are contemplating use of a series of numeric characters printed above or below the address block with the length of this series equal to the length of the longest line in the address block. Yet some other countries may use a linear barcode also printed above or below the address block with a similar length restrictions as in the case of numeric characters. These arrangements however do not address any of the processing steps 2, 3 and 4.

For many mail pieces, computation and formatting of the data needed to create a mail piece including the destination address block and the indicia is done by a computer (e.g. a standard off-the-shelf Personal Computer). The processes of addressing, postage evidencing, mail sorting, and automated payment verification is greatly facilitated by the present system in computing certain auxiliary information from the destination address data and printing this information in an appropriate location and orientation in the vicinity of the destination address block or indicium or both. Alternatively, this information may be printed in any other location on the mail piece but should be indicative of the address block coordinates within an appropriate coordinate system with an origin that can be automatically located easily and without errors. Thus, mail preparation and processing, mail sorting and payment verification, is enhanced by printing certain additional information on the mail piece. Integration of mail processing and payment verification is also advantageous and very cost effective when both processes can benefit from such integration, for example, during an automated mail sorting process.

As previously noted, the process of producing digital tokens, digital signature or ciphertext by postage evidencing devices is well known. The input to the digital token transformation may be formed by the date of mailing, postage value, non-resettable serial piece count or the value of the ascending register (understood in a traditional sense of the postage meter architecture), the postal code of the post office which registered the device, and some other optional information if desired. The digital token transformation generates a pseudo-random number or digital token from these data by applying a secret key. In one known implementation the algorithm employed is double or triple DES in a Cipher-Block-Chaining Mode. The resulting MAC is truncated to a single digit, which represents a single digital token. Two digits can be used to represent two digital tokens, etc. If desired, digital tokens can be longer than a single digit, up to the full MAC. Each digit appears to be a random number to a party without knowledge of the secret key. The idea of employing two separate secret keys (one controlled by the vendor of postage evidencing device and another controlled by the accepting Post) is also well known.

The System

A mailing envelope may contain traditional elements, such as indicia and destination address block. As an example, the indicia may consist of two blocks of data, the human readable block with conventional elements such as postage and date and bar coded block. This bar-coded block contains digital tokens and other data elements that can assist in automated mail sorting such as data elements which can help in facilitating mail reading processes mentioned above. It should be expressly noted that the present system could be implemented in various forms. For example if a public key cryptographic scheme is used, then the indicium can contain a digital signature (with or without public key certificate signed by a Certification Authority) as well as just a ciphertext. The ciphertext for all known secure public key systems is fairly large and independent of the size of the plain text up to the upper limit determined by the size of the key used. This means that in many applications of secure indicia there is room in the plain text that would normally be padded by non-functional information. Thus, this room can be used to include in the plain text (and subsequently retrieve from the ciphertext) certain information useful for address processing, such as, for example, coordinates of the address block, composition of the address block in terms of the number of lines, number of words and number of characters in each line, the identity of the print font used for printing the address etc. Such information together with an appropriate Error Correction Code (ECC) can greatly improve computer processing of the address, essentially eliminating all irrecoverable errors at least in the PC metering environment and, more generally, when mail pieces to be processed have been imprinted by computer driven systems.

One of the purposes of the method of the present system is to provide an effective deterrence and detection mechanisms for duplicated digital indicia. From this point of view, if an unscrupulous mailer purposely changes the address by corrupting the address information, for example, by introducing several extra characters or changing several characters or words in order to create corrupted but deliverable addresses, such that this address will have an Error Correction Code and an address structure information identical to the Error Correction Code and address structure information of another legitimate address, such event is easily detectable by mail carriers (and other postal personnel with the access to mail) by a simple direct visual examination. Thus, mail pieces with addresses altered in such manner will arouse suspicion being unusually addressed, and so pointing to such unscrupulous mailer. This will warrant investigation, which can easily detect the fraud upon interception of several different pieces with identical indicia. If a certified copy of the address data base and address cleansing software is supplied to a mailer, then the cleansing software will automatically eliminate all artificially created errors and misspellings at least for all addresses common to the mailer's mailing list and the data base. (This covers a vast majority of the mailing lists used by business and recreational mailers even without regular updating of address database). If mailer still proceeds with artificial alteration of the delivery addresses in order to avoid payment by duplication of legitimate indicia, then this, again, can be detected by simple direct visual examination. In this case the postal law enforcement authority will have a proof of deliberate alteration by the mailer for the purpose of fraud since no computer system in possession of an adequate address data base will generate mail with such corrupted addresses. This could, for example, be a certified address data base.

The system may be implemented with a PC or equivalent (e.g. single board computer), a vault (also known as PED) operatively connected to the PC and a printer driven by a PC. The mailer may enter into the PC (e.g. via some external storage media, such as magnetic diskette, CD ROM, network or a key board) mailing list of addresses of recipients (where the mailer wants to mail his or her messages)

together with an associated list of rating parameters or postage rates for each mailing address. Typically, the rating parameters consists of weight and an indicator of the size of the mail piece (regular or oversize). The rating parameters together with the rating table (or tariff table) stored in the PC should enable the PC to compute postage value for each of the addresses in the mailing list. After performing postage computation, the PC computes an Error Correction Code (ECC) for each address. This ECC can be of many different types, linear or nonlinear depending on the computational requirements and capabilities of the coding and decoding systems. In the mailing environment, these computational constraints are usually not as strong as in high-speed high bandwidth communications networks.

One commonly used type of ECC is the Reed-Solomon Code (R. Blahut, Theory and practice of Error Control Codes, Addison-Wesley Pub. Co, 1984). The Reed-Solomon Code is constructed over the finite field GF(q), where q is the number of elements in the field. N is the length of the code, that is, the code word uses N field elements and it is a factor of the number of non zero elements in the field. If the dimension of the code is k (i.e. there are $q^k$ code words) then (N, k) Reed-Solomon code (RS code) over GF(q) can detect N−k errors or correct [(N−k)/2] errors, where square bracket denote the largest integer smaller than or equal to (N−k)/2. In the case of error correction two types of errors are typically considered: erasures (known in the OCR field as rejections) and errors of misrepresentation (known in the OCR field as substitutions). The distance for the RS code is d=N−k+1. The RS code with such distance can correct "s" substitutions and "r" rejections if d>2s+r. The delivery address information including the structural information defined as the number of lines in the address, the number of words and characters including spaces in each line, the code for the type(s) of printing font and possibly other similar characteristics can be represented as a binary array or a message over the alphabet {0,1}. A second possible alphabet is used to represent the message for example as a 128 symbols (each symbol being an ASCII code of 1 byte). Out of 128 symbols, 112 symbols represent address and its structural information and 16 symbols represent parity (correction) symbols.

Yet another example uses the properties of the alphanumeric alphabet with upper case letters, numerals, a space, a new line, and a punctuation symbol. A RS code using GF(1601) encodes two of these characters per field element. Selecting field element 13 as a generator, we find that 13 has order 64, i.e. $13^{64}=1 \bmod 1601$. The address read-assistance code consists of error correction information and address structure information. To correct 5 substitutions or 10 rejections requires 11 field elements. The address structure information, which consists of, for example, number of characters in each of a maximum of five lines uses 3 field elements. The address read-assistance code thus utilizes 11+3=14 field elements. 63 field elements represent a single codeword in this Reed Solomon code. The remaining 63−14=49 field elements are used to represent delivery address information, which in this case is limited to a maximum of 98 characters. The address-read-assistance code can be represented in the form of a two-dimensional bar code such as DataMatrix code. In this case, the amount of space in the address block required to do so is 0.34 inches square with the module size equal to 0.020 inch. This is quite feasible. The error correcting capability of the code just described will be able to correct performance of even very modestly accurate OCR algorithm (90% accurate recognition rate).

The verification process applicable to the present method involves first scanning the mail piece and obtaining a digital image of the indicia and the address block. The second phase of the verification is as mentioned above a direct examination of printed delivery address by mail handling and delivery personnel in order to detect any artificially created errors. This second phase can also be automated when address reading software is updated to detect and flag any unusual errors and misspellings. Both the manual and automated methods can be used if needed since they take place during different stages of mail processing cycle.

Structure and Organization

Reference is now made to FIG. 1. A computing system 102 which may be, for example, a personal computer 104 includes optionally an address data base 106. It should be recognized that the system can either be a stand alone PC system or a network system or other suitable computing arrangement. A printer 108 prints a series of mail pieces shown generally at 110. The mail pieces may include a 2D bar code encrypted indicia shown at 112 and have imprinted format error correction code information for addressee information on the mail piece shown at 114.

The encrypted indicia includes information authenticating the payment of postage for the mail piece. A relationship may exist between the addressee information error correction bar code and the encrypted information so as to provide an enhanced robust digital token generating and verification system. As noted above, the system accommodates digital token verification where addressing information cannot be recreated in automated mail processing and in situations where the addressee information error correction code cannot be accurately obtained. The system also provides a enhanced ability to recover addressee information in a way that facilitates mail processing.

The mail pieces 110 are submitted to a receiving facility shown generally at 116. The mail stream may be processed by a sorter 118 which reads addresses associated with the mail piece with the assistance of the error correction code. A sampling of the mail stream may be fed to a verification processing system shown generally at 120 as sampled mail piece 122 is scanned by a scanner 124, which is connected to a verifier processor 126. For secret key systems, that is, systems where the digital token is encrypted using a secret key, a crypto co-processor 128 may be coupled to the verifier processor 126. A crypto key data base 130 is coupled to the verifier processor 126.

It should be recognized that the particular printing system and the particular verifying system is a matter of systems design choice. For example, rather than employing a secret key system for generating the digital tokens a public key system may be employed for generating the digital token. Alternatively, various forms of encryption may be employed in the system as, for example, elliptic curve digital signature, data encryption standard and RSA. Furthermore, the form and format of the printed information can be substantially modified and beneficially employ the aspects of the present invention. The key data base 130 may not be required where the digital indicia includes a digital certificate as set forth in the USPS Information based Indicia proposed Specifications and in U.S. Pat. No. 4,853,961 issued Aug. 1, 1989 for RELIABLE DOCUMENT AUTHENTICATION SYSTEM.

Figure 2:
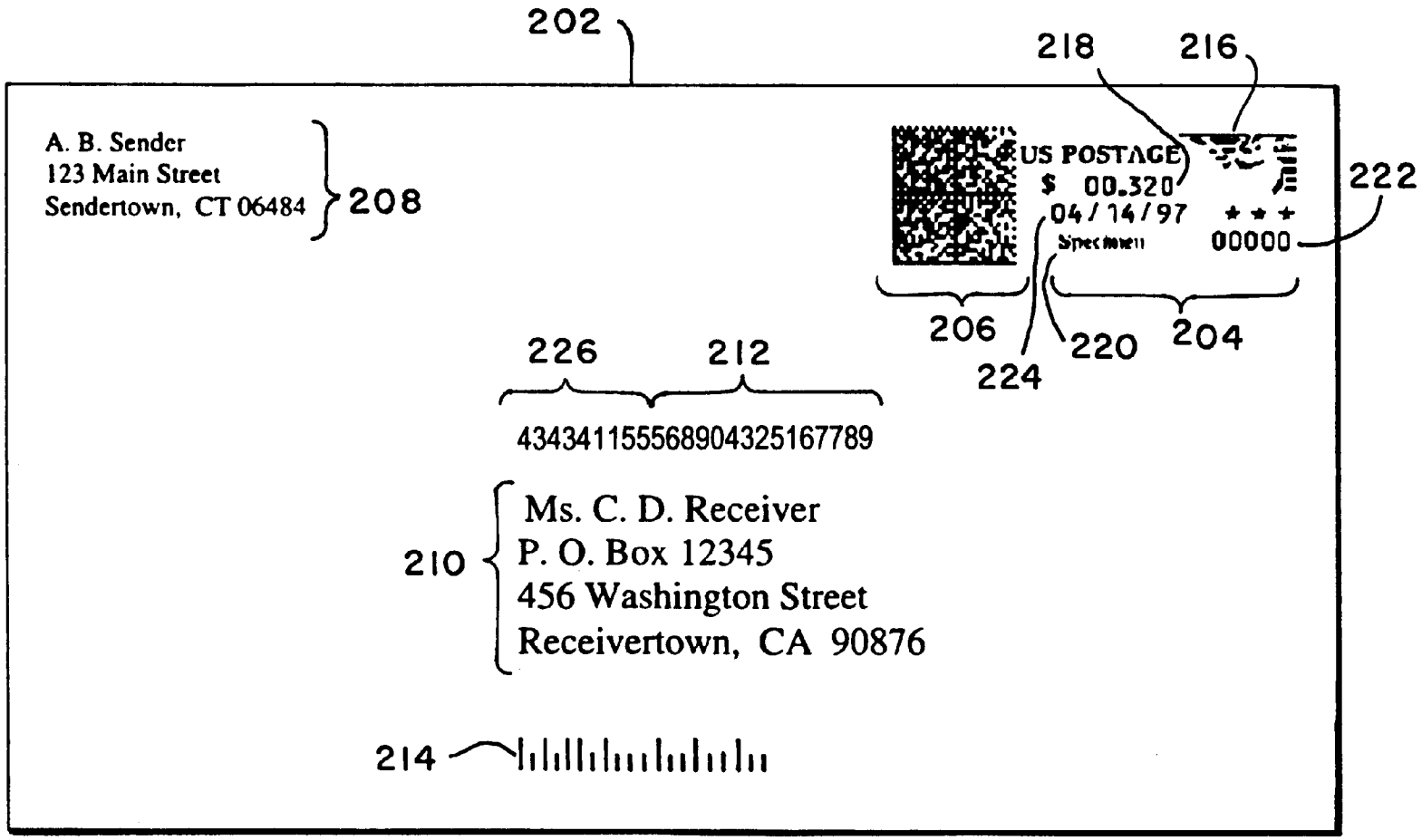
FIG. 2 is a mail piece printed by the system shown in FIG. 1 and includes formatting information and an error correcting code printed on the mail piece in alpha numeric form and with the error correction code included in the calculation of the digital token printed as part of a 2D bar code.

Reference is now made to FIG. 2. A mail piece 202 includes a indicia shown at 204 and a 2D bar code shown at 206. Sender address information is shown at 208 and recipient addressee information at 210. An error correction code for recreating the addressee information 210 is generated and printed on the mail piece at 212. A bar-half bar, for example, code may also be imprinted on the mail piece at 214. The indicia shown at 204 may include graphic information 216, postage amount information 218, meter or secure token generator serial no. 220, origin postal code 222 and the date of the imprint 224. Some or all of this information may be encrypted into the 2D bar code 206 as part of the digital token along with all or part of the error correction code 212. This digital token incorporating this information may be retrieved through scanning at a later time, to verify the authenticity of the indicia 204. The bar-half bar code 214 may be a Post Net bar code which may include any desired information to assist existing scanning equipment at postal services in the writing process. This information may be the complete 11 digit destination point delivery code (5 digit Zip plus 4 digit plus 2 digit code) as employed in the United State Postal Service or portions of the addressee information, such as the destination code of the receiving post office. It should be noted that the mail piece has printed on it two different forms of bar code as well as other information to make the system more robust.

Certain address block structure information 226 may also be included on the mail piece. This address block structure information may include the coordinates of the address block, composition of the address block in terms of the number of lines, number of words and number of characters in each line, the identity of the print font used for printing the address, etc. Such information shown diagrammatically at 226, together with an appropriate error correction code 212 can greatly improve computer processing of the address, and may, greatly reduce or essentially eliminate all irrecoverable errors, particularly in computer controlled mail printing environment.

It should be expressly noted that not only can the error correction code 212 be included in the digital token transformation process but, additionally, this additional information 226 can also be beneficially included as part of the digital token.

It should be explicitly recognized that the formatting information 226 is very important in augmenting the information provided by the error correction code to enable the recovery of the correct addressee information 210. This is particularly true because certain corrupted information as read from a mail piece may preclude the error correction code from enabling the recreation of the addressee information. One such example would be where the scanning process misconstrues two adjacent characters or numbers as being a single letter such as the sequence of letters "IV" being interpreted as an "N." In such case, the error correction code would not, in and of itself, necessarily be sufficient to recreate the correct addressee information. However, along with the formatting information, such recovery may be facilitated.

It should be recognized that while the United States Postal Service Information Based Indicium Program draft specification employs the delivery point destination code for use in the digital token transformation process, the present system is more universal and more secure in that it does not rely on a particular addressing scheme as, for example, one employing zip code information and further is specific to the specific addressee or recipient of the mail piece. This further enhances the protection against a duplicate attack on the system where duplicate mail pieces are entered into the mail stream.

One implementation for address structure information 226 is shown in the first seven digits "4343411" above the address. The first digit "4" represents the distance in inches from the right edge of the envelope to the left edge of the address. The second digit "3" represents the distance in inches from the top of the envelope to bottom of the address block. The third digit "4" is the number of lines in the address field. The remaining four digits "3411" are each calculated from the number of characters and number of words in a line. The first of these four digits "3" corresponds to the first line of the address. The code for a line is given by ((number of characters) mod 3)+3.((number of words) mod 3), where mod 3 is the remainder after dividing by 3. The two values, ((number of characters) mod 3) and 3.((number of words) mod 3) can be easily calculated from the code.

The first line "Ms. C. D. Receiver" contains 4 words and 12 characters. The code is therefore "3". The other lines follow similarly. "P.O. Box 12345" has four words and ten characters. The structure code for this line is therefore "4". The street address, "456 Washington Street" has three words and nineteen characters, as does the city-state line. The last two lines therefore correspond to "1".

In this example, a character is either a letter or a numeral; punctuation and spaces are not included as characters. Any string separated by a space or punctuation is treated as a separate word. Therefore, "C.D." counts as two characters and two words. Many other implementations are possible, including counting punctuation as characters, only counting word boundaries with spaces or including more detailed information about each word.

Figure 3:
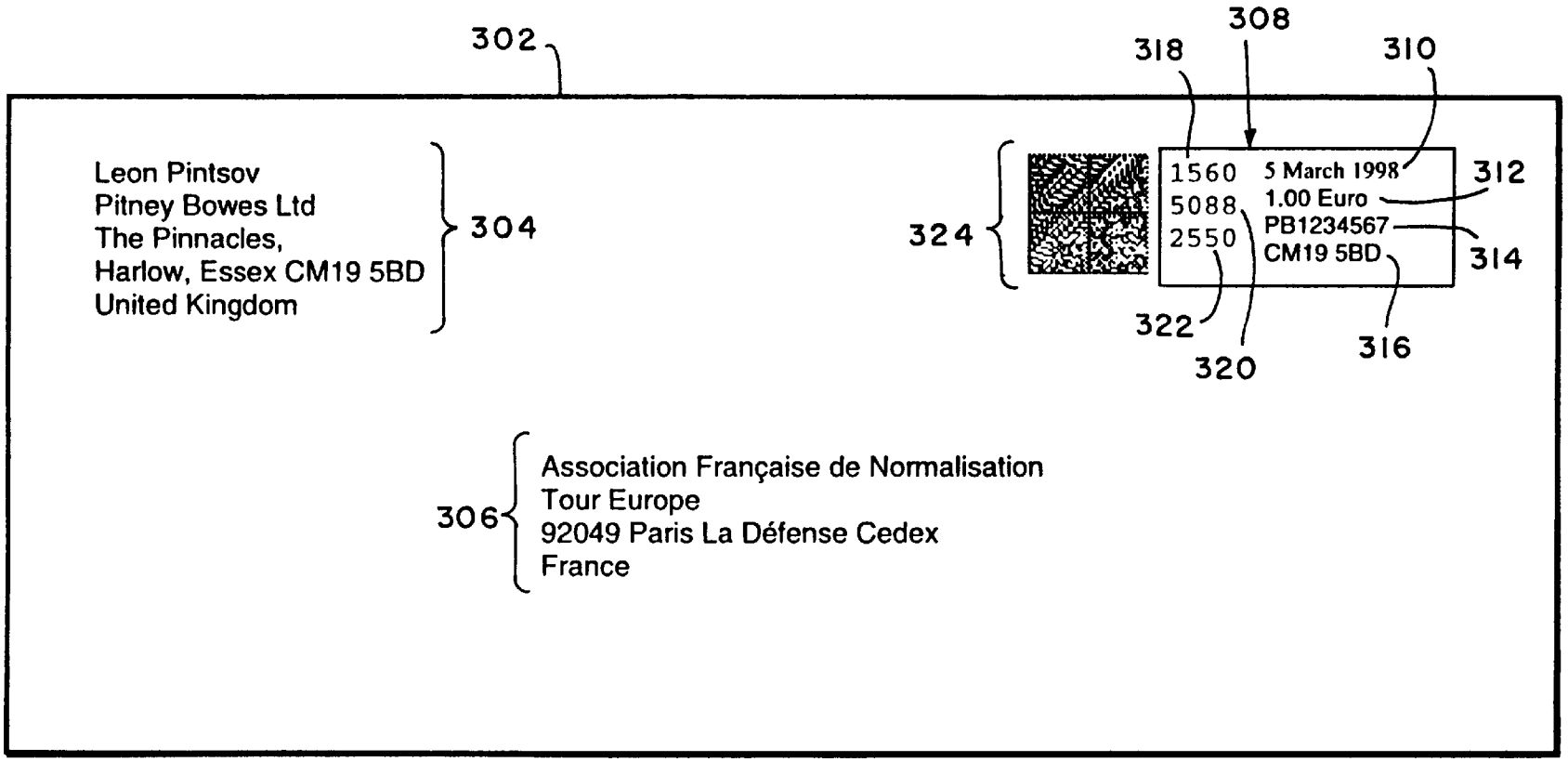
FIG. 3 is a mail piece printed by the system shown in FIG. 1 and having the error correction code printed in the 2D bar code and an indicia having alpha numeric digital tokens which includes, as part of the input to the DTT, the error correction code.

Reference is now made to FIG. 3. A mail piece 302 contains a sender address information at 304 and recipient addressee information at 306. It should be noted that the addresses involved are addresses in the United Kingdom and France as opposed to the addresses in FIG. 1 involving addresses in the United States. This is because the present invention is suitable for use with all forms of addressing schemes employed by the world wide postal services. An indicia 308 includes various relevant information. A date of mailing is imprinted at 310 as well as the postal amount at 312. The amount shown is one Euro. Additionally, the metering or secure encrypting device serial number is imprinted at 314 as is the originating postal code of the mail piece at 316. Digital token information is imprinted on the mail piece at 318. The digital tokens may be single digit tokens such as the 5 and the 6, one associated with the vendor and one associated with the postal services as set forth in the above noted prior patents. The numeral 1 may be a designation of the manufacturer and the numeral 0 is an error detection code associated with the metering device number. An error detection code for the entire indicia may be provided at 320 and a serial piece count associated with the metering device at 322.

A 2D bar code 324 is imprinted adjacent to the digital indicia. The 2D bar code 324 may include the digital tokens 5 and 6 printed in alpha numeric form as part of the digital indicia and further include an error correction code associated with the addressee information 306 and similar to the information contained in the numeric code 212. Additionally, the 2D bar code 324 may include the formatting information associated with the addressee information 306 similar to the formatting information imprinted in numeric form at 226 as shown in FIG. 2.

Figure 4:
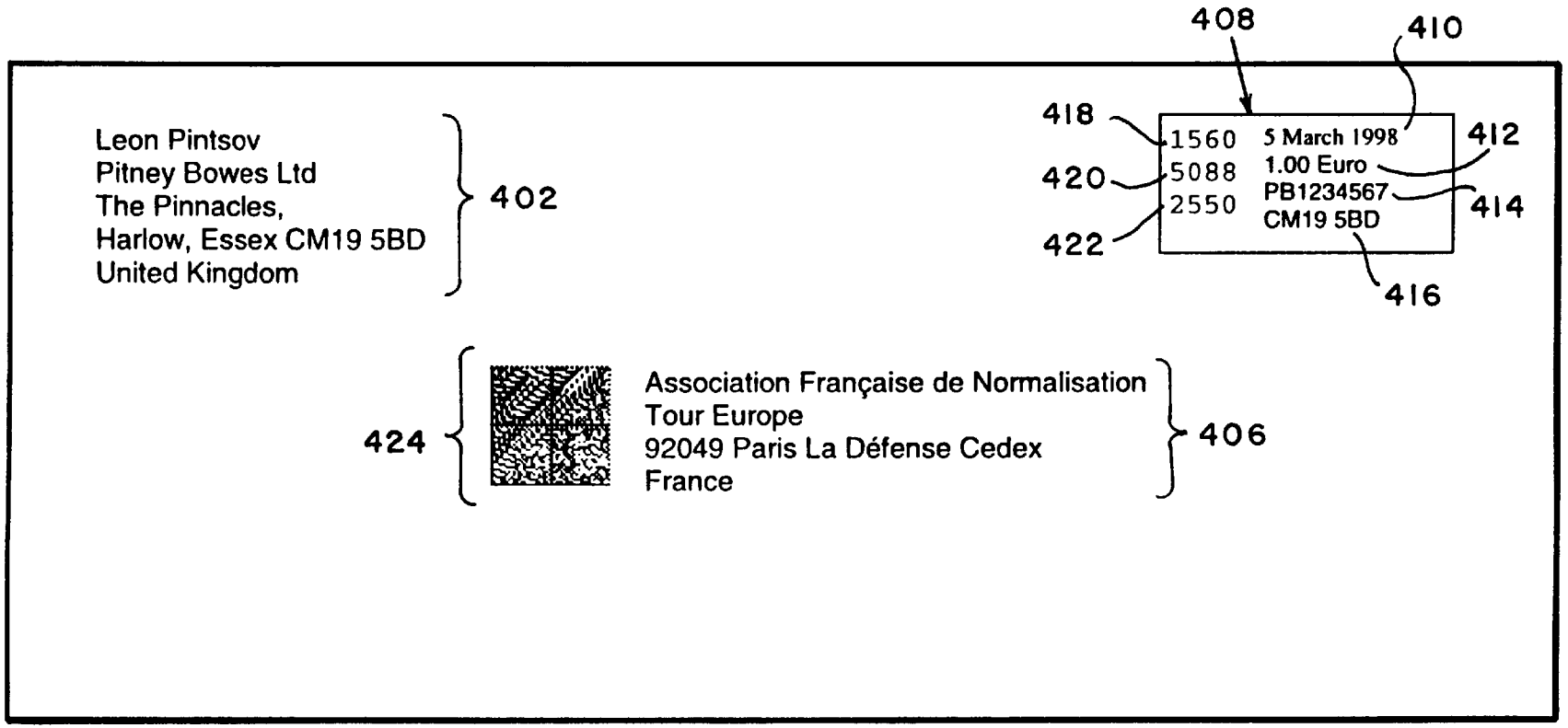
FIG. 4 is a mail piece similar to that shown in FIG. 3, with the 2D bar code relocated adjacent the address block to provide enhanced address block landmark identification.

Reference is now made to FIG. 4. FIG. 4 includes similar information to that shown in FIG. 3. Corresponding type numbers show corresponding elements in FIG. 4. The 2D bar code 424, however, is imprinted adjacent to the addressee information 406. By imprinting the 2D bar code 424, as shown in FIG. 4, a major landmark is provided for the scanning equipment to locate the area which contains the addressee information. This is particularly important since mail pieces come in various sizes and forms and addressee information is imprinted in many different locations on such mail pieces and in many different formats and styles. Moreover, since much other extraneous information may be imprinted on a mail piece such as "express mail", "open immediately," "air mail", etc., the provision of a major landmark such as the 2D bar code 424 provides great assistance. Since the landmark 424 is also the 2D bar code providing the necessary information, including the formatting information and the error correction code, valuable real estate on the mail piece is saved, as opposed to having the 2D bar code in a different location with a different form of addressee landmark identification imprinted on the mail piece.

Figure 5:
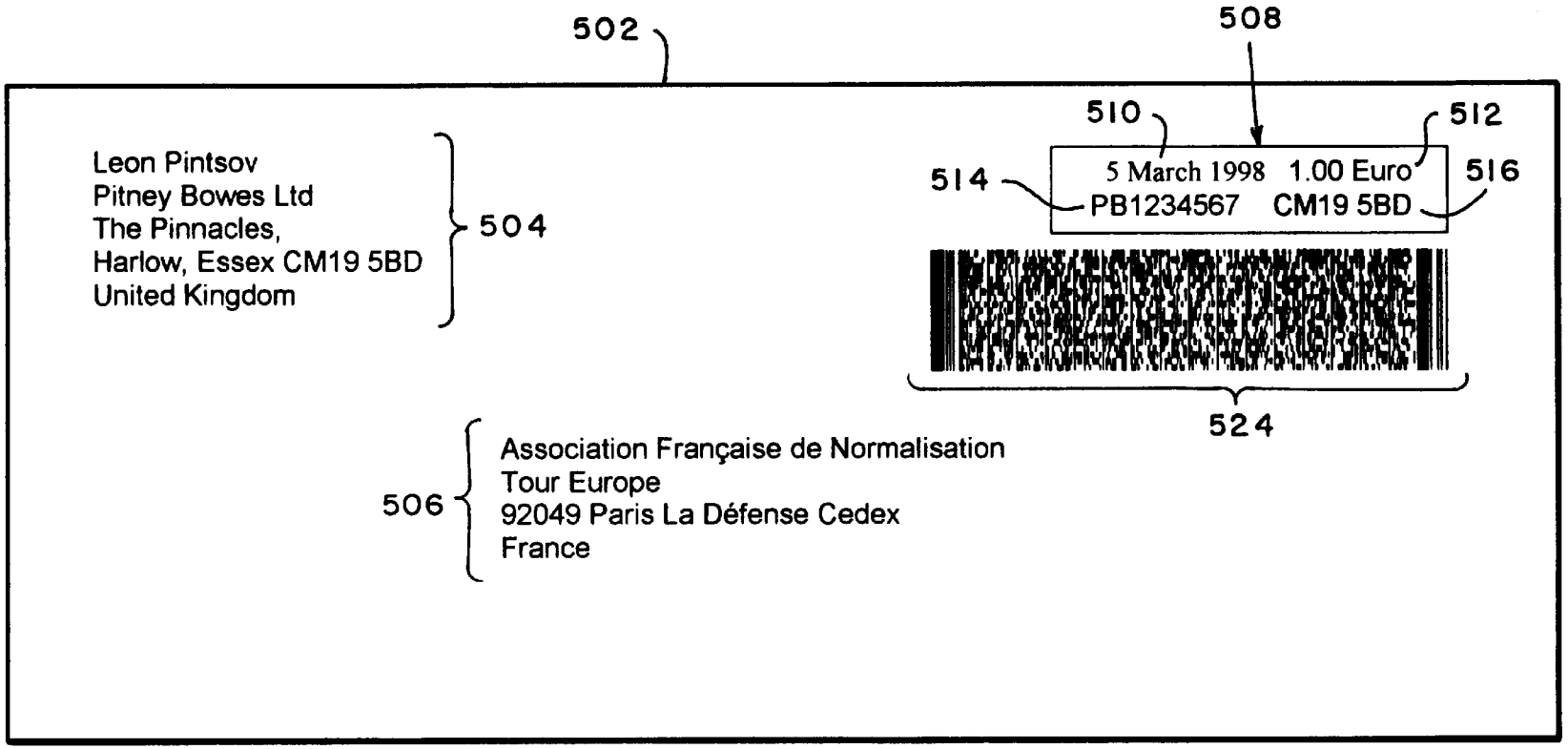
FIG. 5 is a mail piece similar to that shown in FIG. 3 incorporating a different form of 2D bar code and with the imprinted bar code located in a different position relative to the imprinted indicia.

Reference is now made to FIG. 5. A mail piece 502 includes sender address information 504 and addressee information 506. The particular indicia shown on the mail piece in FIG. 5 is divided between human readable portion and a 2D bar code portion. The human a readable portion 508 includes the date the mail was imprinted at 510, the postal amount at 512, the serial number of the metering device at 514 and the sender postal code at 516. A 2D bar code at 524 includes the digital token as well as the error correction code information shown at 212 in FIG. 2 and the address structure information shown at 226 in FIG. 2. All this information along with the various encrypted information authenticating the mail piece as having postage paid is imprinted in the 2D bar code 524.

The 2D bar codes shown in FIGS. 2, 3 and 4 are DataMatrix type 2D bar codes. The 2D bar code shown in FIG. 5 is a PDF417 type bar code. The indicia imprinted on mail piece 5 may be a public key encryption scheme based digital indicia which is imprinted in the PDF417 format as shown at 524.

As is apparent from the above four different formats of mail pieces shown in FIGS. 2–5, various forms and organizations of the present invention employing error correction code and/or format information as part of the encryption of addressee information into the digital tokens may be employed. Moreover, these digital tokens may be of the secret key type or the public key type, depending upon the particular system implemented.

Figure 6:
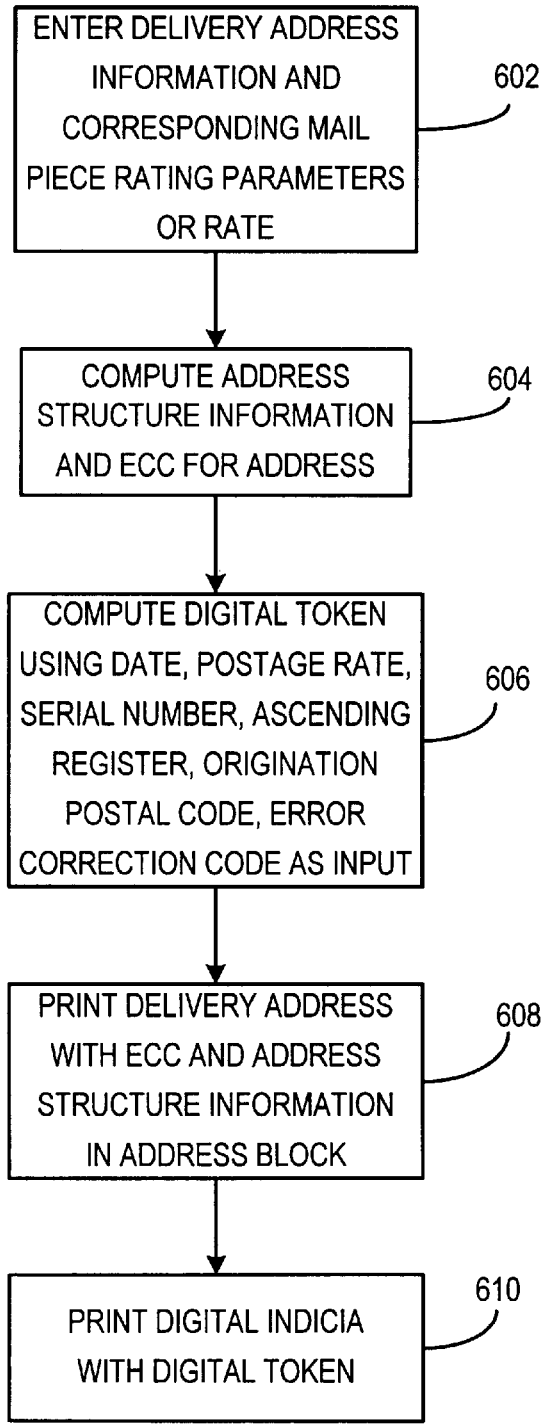
FIG. 6 is a flow chart of the mail piece generation process employing the present invention; and, FIG. 7 is a flow chart of the verification process of the mail piece created in accordance with the process shown on FIG. 6.

Reference is now made to FIG. 6. The delivery address information and corresponding mail piece rating parameters or rate are entered into the processing system 104 of FIG. 1 at 602. Address structure information and error correction code for the address is computed at 604. The digital token is then computed at 606. The digital token maybe of a type encrypting the calendar date, postage rate data, metering device serial number, ascending register, and originating postal code. The specific information and the type of digital token transformation as well as the particular encryption algorithm employed may vary depending upon the system design choice. The digital token also employs the error correction code and/or the address structure information as input computed at the step 604. The delivery address with error correction code and address structure information is printed on the mail piece at 608. It should be noted that if the format employed is as shown in FIG. 2, the information at 608 is printed as part of the address block. However, the information maybe printed in different forms and in different locations as shown in FIGS. 3–5. The digital indicia, including the digital token, is printed at 610. Optionally, an ad slogan may also imprinted at this time.

Figure 7:
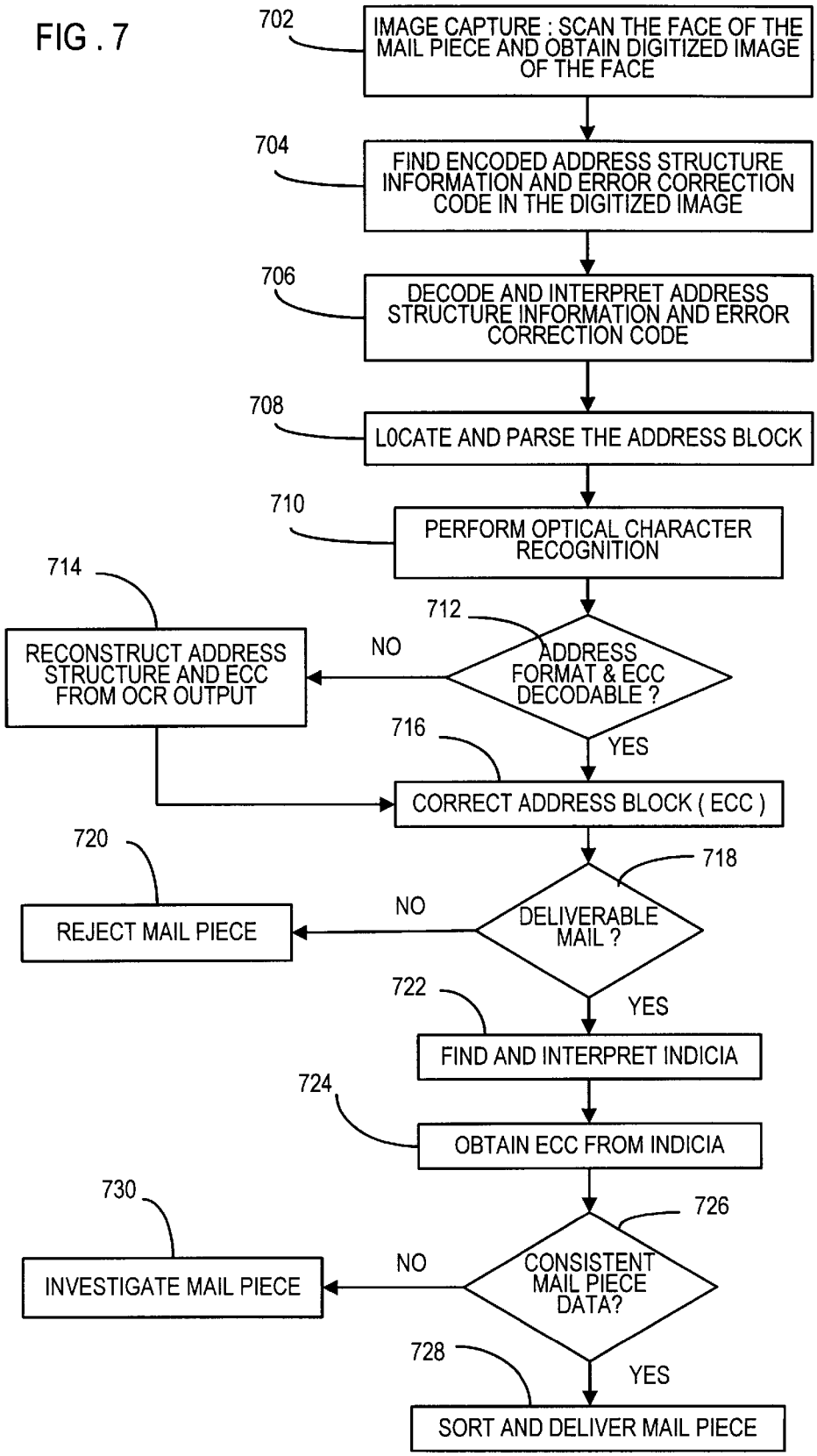

Reference is now made to FIG. 7 showing the operation at the verification facility. The face of the mail piece is scanned and the image is obtained and digitized at 702. The encoded address structure information and error correction code is determined from the digitized image at 704. The address structure information and error correction code is decoded and interpreted at 706. The address block is located and parsed at 708 in preparation for further processing. The further processing includes optical character recognition which is performed at 710. A determination is made at 712 whether the address structure and error correction code is decodable.

If the address structure and error correction code is not decodable, the address structure and error correction code is reconstructed from the OCR output at 714. This step provides the added utility of insuring a higher number of mail pieces will be verifiable not withstanding inability to decode address structure and error correction code information. As noted above, the error correction code and/or address structure information are included in the encryption digital token transformation to generate the digital token imprinted on the mail piece. Without this information, the mail piece indicia cannot be verified to determine its authenticity and payment of postage. Accordingly, the ability as part of the process to reconstruct the address structure and error correction code from the OCR output provides an enhancement and improved robustness of the entire process not found in prior systems.

After the address structure and error correction code is reconstructed from the OCR output, a determination is made that the correct address block has been obtained at 716. This block is directly accessed from decision block 712 if the address format and error correction code was decodable. A further determination is made at 718 as to whether the mail is deliverable. If the mail is not deliverable, that is, incomplete or undeliverable address or unrecoverable address, the mail piece is rejected at 720.

If the mail piece is deliverable, the indicia is found and interpreted at 722. Additionally, and optionally, if the error correction code is in the indicia itself in unencrypted form as may be the case as explained in connection with FIGS. 3–5, the error correction code is obtained from the indicia at 724 or from the 2D bar code, as the case may be. A determination may be made at decision block 726 whether the mail piece data is consistent. This can be for example an analysis to determine consistency between the address structure information and the error correction information obtained at 706. The address block information obtained at 710, the indicia information obtained at 722 and, optionally, should it be the case, the error correction code information obtained at 724 are all, or some portion thereof, are consistent. This check for consistency can also include the verification of the digital token as being an authentic digital token for the sample number of mail pieces tested which can be from a very small sample to essentially a 100% of the mail pieces, depending upon the level of security and verification that is needed for the system design.

If the mail pieces are determined to be consistent, the mail pieces are sorted and delivered at 728. If, on the other hand, the mail piece data is not consistent, an investigation of the mail piece may be initiated at 730.

An alternate embodiment of the system for a printed document is a "document read-assistance and authentication code."

A bar code may contain the "document read-assistance and authentication code." This bar code may employ an internal error-correcting code, thus assuring reliable reading. The code may consist of some or all of the following:

1) Formatting information indicating the number of pages and lines per page.

2) Formatting information that indicates the number of words and characters in each line.

3) Other formatting information, such as overall geometric description of the page, fonts used, paragraph format, etc.

4) An indication which parts of the document (for example, which lines) are included in the error-correcting code.

5) An error-correcting code for the indicated parts. The level of error-correction can be different for different parts of the document.

6) A cryptographic digital signature computed using the error-correcting code and formatting information.

The error-correcting code can be strong enough to make intractable the problem of finding another usable document contents with the identical code. As an extreme example, the error-correcting code can be strong enough to reconstruct the whole document, or the indicated parts.

The level of error correction can be different for different parts of the document. A simple error-detection code can be used for some lines; some selected critical lines may, at the signer's discretion, employ a code that allows reconstruction of the selected lines. Even the error-detection code, combined with the formatting information, provides valuable assistance for accurate optical character recognition. This information assists with parsing a line into words and characters, and provides a measure that allows accurate decisions where the OCR output is uncertain.

The cryptographic signature provides assurance that the document source is authentic and the document is unchanged.

There are several advantages to generating the cryptographic signature using the error-correcting code and the formatting information. If some part of the document cannot be reconstructed completely, the signature can still be verified. If "most" of the document read-assistance code matches the readable part of the document, then the signature provides a signer-selectable level of assurance. By verifying a signature associated, to varying degrees with the whole document, the reader is provided assurance that the document part with strong error correction is indeed part of the overall document. There is a significant difficulty with verifying a digital signature based on a secure hash. Every part of the input must be read exactly correctly for the signature to verify. While this is quite possible for a document in digital form, it is much more difficult for a printed document.

While the present invention has been disclosed and described with reference to a single embodiment thereof, it will be apparent, as noted above that variations and modifications may be made therein. It is, thus, intended in the following claims to cover each variation and modification that falls within the true spirit and scope of the present invention.

What is claimed is:

1. A method for generating postage evidencing information comprising the steps of:

generating an error correction code for at least a portion of a destination address; and, generating a digital token employing said error correction code.

2. A method for verifying postage evidence information printed on a mail piece, comprising the steps of:

obtaining an error correction code corresponding to at least a portion of a destination address printed on a mail piece; and, employing said obtained error correction code to verify the validity of said postage evidencing information.

3. A method for verifying postage evidencing information printed on a mail piece, comprising the steps of:

obtaining an error correction code printed on a mail piece;

determining that the obtained error correction code is inaccurate;

obtaining the information employed to generate said inaccurate error correction code;

generating an error correction code from said obtained information; and, employing said generated error correction code to verify the validity of said postage evidencing information.

4. A method for verifying postage evidencing information printed on a mail piece, comprising the steps of:

obtaining an error correction code printed on a mail piece for other information printed on a mail piece;

determining that the obtained error correction code is inaccurate;

obtaining said other information employed to generate said printed error correction code;

attempting to regenerate said error correction code from said obtained other information;

determining that the obtained other information is inaccurate;

employing said obtained error correction code and said obtained other information to regenerated a correct error correction code for said other information; and, employing said regenerated correct error correction code to verify the validity of said postage evidencing information.

5. A method for verifying postage evidencing information printed on a mail piece, comprising the steps of:

generating an error correction code from at least a portion of addressee information printed on said mail piece; and, employing said generated error correction code to verify the validity of said postage evidencing information.

6. A method of claim 5 further comprising the step of imprinting said address information on said mail piece.

7. A method as defined in claim 5 wherein said error correction code and said address information are imprinted on said mail piece in bar code format.

8. A method as defined in claim 5 wherein said address information includes at least one of: the number of characters in a line, mail piece coordinates of the address block on the mail piece, font type, number of lines in the address and number of words in each line and total number of characters in the address block.

9. A method for verifying postage evidencing information printed on a mail piece, comprising the steps of:

obtaining an error correction code printed on a mail piece for other information printed on a mail piece;

determining that the obtained error correction code is inaccurate;

obtaining said other information employed to generate said printed error correction code;

regenerating said error correction code from said obtained other information; and, employing said regenerated correct error code to verify the validity of said postage evidencing information.

10. A method for generating postage evidencing information comprising the steps of:

generating an error correction code for at least a portion of destination address;

generating address structure information for said destination address;

imprinting said error correction code and address structure information on said mail piece; and, generating a digital token employing said error correction code and said address structure information.

11. A method of as defined in claim 10 further comprising the step of imprinting said destination address on said mail piece.

12. A method as defined in claim 10 wherein said error correction code and said address structure information are imprinted on said mail piece in bar code format.

13. A method as defined in claim 10 wherein said address structure information includes at least one of the number of: characters in a line, coordinates of the address block on the mail piece, font type, number of lines in the address, number of words in each line and total number of characters in the address block.

14. A method for generating authentication and data integrity information comprising the steps of:

generating an error correction code for information in a document; and, generating a digital token employing said error correction code.

15. A method for verifying authentication and integrity information printed on a document, comprising the steps of:

obtaining an error correction code printed on said document; and, employing said obtained error correction code to verify the validity of said evidencing information.

16. A method for generating authentication and integrity information comprising the steps of:

generating an error correction code for information printed on a document;

generating document structure information for said information printed on said document;

imprinting said error correction code and document structure information on said document; and, generating a digital token employing said error correction code and said address structure information.

17. A method as defined in claim 16 wherein said document structure information, includes at least one of: the number of characters in a line, font type, number of lines in said destination address, number of words in each line and total number of characters in the document.

18. A method for verifying postage evidencing information comprising the steps of:

generating a first error correction code for at least a portion of a destination address of a mail piece;

generating a first digital token including said first error correction code;

including the first digital token in a postal indicia on the mail piece scanning said mail piece at a mail piece processing location for information from the mail piece;

generating a second error correction code from the information;

computing a second digital token using said second error correction code;

determining mail piece validity by comparing said first digital token and said second digital token.

19. A method for verifying postage evidencing information comprising the steps of:

generating an error correction code for at least a portion of a mail piece destination address;

generating a first digital token including said error correction code;

scanning said mail piece at a mail piece processing location to obtain mail piece information;

obtaining said error correction code from said mail piece information and said destination address;

determining whether said obtained error correction code corresponds to said obtained destination address;

a) generating a second digital token using said obtained error correction code when said obtained error correction code corresponds to said obtained destination address;

b) determining mail piece validity based upon a comparison of first and second digital tokens; or, c) regenerating said error correction code when said obtained error correction code does not correspond with said obtained destination address;

d) generating the second digital token using said regenerated error correction code; and e) determining mail piece validity based upon said computed digital token and said regenerated digital token.

* * * * *